US007077514B2

(12) United States Patent
Inoue et al.

(10) Patent No.: US 7,077,514 B2
(45) Date of Patent: Jul. 18, 2006

(54) LIQUID CONTAINER, LIQUID USING APPARATUS, PRINTING APPARATUS, AND INK JET CARTRIDGE

(75) Inventors: Ryoji Inoue, Kanagawa (JP); Ryoichi Matsumoto, Tokyo (JP); Tatsuo Nanjo, Kanagawa (JP); Hideki Ogura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 151 days.

(21) Appl. No.: 10/805,192

(22) Filed: Mar. 22, 2004

(65) Prior Publication Data

US 2004/0196340 A1 Oct. 7, 2004

(30) Foreign Application Priority Data

Apr. 4, 2003 (JP) ..... 2003-102069
Feb. 20, 2004 (JP) ..... 2004-045385

(51) Int. Cl.
*B41J 2/175* (2006.01)

(52) U.S. Cl. ..... 347/86; 347/87

(58) Field of Classification Search ..... 347/85, 347/86, 87; 141/1, 18
See application file for complete search history.

(56) References Cited

U.S. PATENT DOCUMENTS

| | | | | |
|---|---|---|---|---|
| 4,509,062 | A | 4/1985 | Low et al. | 346/140 R |
| 4,628,333 | A * | 12/1986 | Terasawa | 347/87 |
| 5,409,134 | A | 4/1995 | Cowger et al. | 222/1 |
| 5,600,358 | A | 2/1997 | Baldwin et al. | 347/87 |
| 5,646,666 | A * | 7/1997 | Cowger et al. | 347/87 |
| 6,481,837 | B1 * | 11/2002 | Askren et al. | 347/85 |
| 6,494,568 | B1 | 12/2002 | Hou et al. | 347/86 |
| 6,585,358 | B1 * | 7/2003 | Usui et al. | 347/85 |
| 6,719,418 | B1 * | 4/2004 | Chou et al. | 347/87 |
| 6,783,219 | B1 * | 8/2004 | Lui et al. | 347/86 |
| 6,976,753 | B1 | 12/2005 | Kuwabara et al. | 347/86 |
| 2001/0010531 | A1 | 8/2001 | Hsieh et al. | 347/86 |
| 2001/0020971 | A1 | 9/2001 | Usui et al. | 347/86 |
| 2002/0101488 | A1 | 8/2002 | Hsu et al. | 347/85 |
| 2002/0109760 | A1 | 8/2002 | Miyazawa et al. | 347/86 |
| 2003/0020794 | A1 | 1/2003 | Chou et al. | 347/87 |
| 2003/0067520 | A1 | 4/2003 | Inoue, et al. | 347/86 |
| 2004/0196341 | A1 | 10/2004 | Ogura, et al. | 347/86 |

FOREIGN PATENT DOCUMENTS

| | | |
|---|---|---|
| EP | 1291184 | 3/2003 |
| EP | 1300247 | 4/2003 |
| JP | 3-24900 | 4/1991 |

(Continued)

*Primary Examiner*—Anh T. N. Vo
(74) *Attorney, Agent, or Firm*—Fitzpatrick, Cella, Harper & Scinto

(57) ABSTRACT

A liquid container is provided which can prevent a leakage of liquid from an air introduction portion under any environment of use and storage and which can maintain a stable negative pressure characteristic irrespective of a degree of liquid consumption. The liquid container includes a liquid containing portion, a liquid supply portion to supply liquid from the liquid containing portion to a liquid using portion, a valve chamber having a one-way valve which permits a gas introduction into the liquid containing portion and prevents the liquid and gas from getting out of the liquid containing portion, a communication path to communicate the liquid containing portion with the valve chamber, a mechanism having a function of maintaining a volume of the liquid containing space, and a communication path closing member capable of enabling or disabling a communication between the liquid containing portion and the valve chamber through the communication path.

18 Claims, 11 Drawing Sheets

FOREIGN PATENT DOCUMENTS

| | | |
|---|---|---|
| JP | 6-183023 | 7/1994 |
| JP | 7-125240 | 5/1995 |
| JP | 7-125241 | 5/1995 |
| JP | 2001-310479 | 11/2001 |
| JP | 2002-103642 | 4/2002 |
| JP | 2003-94682 | 4/2002 |

* cited by examiner

LIQUID CONTAINER, LIQUID USING APPARATUS, PRINTING APPARATUS, AND INK JET CARTRIDGE

This application claims priority from Japanese Patent Application Nos. 2003-102069 filed Apr. 4, 2003 and 2004-045385 filed Feb. 20, 2004, which are incorporated hereinto by reference.

BACKGROUND OF THE INVENTION

1. Field of the Invention

The present invention relates to a liquid container that almost completely and stably supplies a liquid such as ink to a printing unit such as pen and print head. The invention also relates to a liquid using apparatus, a printing apparatus, and an ink jet cartridge.

2. Description of the Related Art

As a liquid using apparatus, such as an ink jet printing apparatus that applies liquid ink to a print medium from an ink jet print head to form an image on the print medium, a variety of types are in use. Some form an image by moving a print head relative to a print medium and at the same time ejecting ink from the traveling print head; and others form an image by moving a print medium relative to a stationary print head and at the same time ejecting ink from the stationary print head.

As for a method of supplying ink to a print head, which can be applied to these ink jet printing apparatus, there are an on-carriage system and a tube supply system. The on-carriage system has an ink tank mounted either inseparably or disconnectably to a print head so that the print head reciprocally travels together (in a main scan direction) carried on a carriage, with ink directly supplied from the ink tank to the print head. In the tube supply system, the ink tank is installed stationary at a separate position in the printing apparatus from the print head mounted on the carriage, with ink supplied through a flexible tube connecting the ink tank and the print head. This tube supply system includes a construction in which a second ink tank functioning as an intermediate tank (sub-tank) between the ink tank (main tank) and a print head is mounted on the print head or the carriage to directly supply ink from this second ink tank to the print head.

In these ink supply systems, the ink tank for directly supplying ink to the print head is provided with a mechanism that generates an appropriate level of negative pressure in a range which forms meniscuses in ink ejection portions of the print head to prevent ink leakage from the ink ejection portions and still allows for ink ejecting from the print head.

IN one example of such a negative pressure generation mechanism, a porous member such as sponge in which soaks and holds ink is installed in the ink tank to generate an appropriate level of negative pressure by its ink holding force.

In another example, ink is filled in a bag member formed of a material, such as rubber, that has an elastic force and generates a tension that tends to expand its volume, to create a negative pressure in the ink contained therein.

In still another example, a bag member is formed of a flexible film and a spring or the like which urges the film in a direction that expands a volume of the bag member is joined to an inside or outside of the bag member to generate a negative pressure.

In either of these mechanisms, however, the negative pressure tends to increase as the ink volume remaining in the ink tank decreases. When the negative pressure exceeds a predetermined level, ink can no longer be supplied stably to the print head. This gives rise to a problem of the ink tank becoming unfit for use before the ink in the ink tank is completely consumed.

For example, Japanese Patent Application Publication No. 3-24900(1991) discloses an ink tank constructed in the form of a hermetically closed, resilient bag member which directly contains ink and can deform according to the volume of ink contained therein and which has a spring member installed therein. In this hermetic bag member (ink tank) disclosed in Japanese Patent Application Publication No. 3-24900(1991), the negative pressure (a difference between the inner pressure of the ink tank and the atmospheric pressure) basically depends on a spring force so as to keep a balance therebetween. Thus, as the bag member deforms as a result of ink consumption and the spring is compressed, the negative pressure in the bag member increases. As a result, the negative pressure may exceed an appropriate range that allows normal ink ejecting from a print head, making it impossible for adequate meniscuses to be formed in the ink ejection portions of the print head or to supply ink stably to the print head. In this case, the ink volume in the bag member cannot be completely used.

There is also an ink tank characterized by a bag member whose material and shape are properly chosen. The bag member contains ink and produces a negative pressure by itself, while becomes flat with no inner space remaining when the ink contained therein is completely used up. This kind of bag member, however, has a limitation on the shape. If an ink tank is constructed of a rectangular parallelepiped case for accommodating a bag member, the bag member, even when loaded with ink, does not assume a shape that perfectly fits in the case, degrading an ink containing efficiency with respect to an overall ink tank space. Even with this bag member, when the ink is about to be used up, the negative pressure is so high as to cause a degradation of performance in supplying ink to the print head or make the ink ejecting operation of the print head unstable.

To prevent the negative pressure from becoming excessively higher than a predetermined level, the following mechanisms have been proposed.

For example, Japanese Patent Application Laid-open Nos. 7-125240(1995) and 7-125241(1995) disclose a mechanism which comprises a hydrophobic film and a tube vent installed in a tank and a ball fitted in the tube and which takes air into the tank when an inner negative pressure increases. More specifically, in the construction disclosed in Japanese Patent Application Laid-open Nos. 7-125240 (1995) and 7-125241(1995), a tube vent (boss) communicating an interior of the ink tank with the outside has a plurality of protruding ribs formed on its inner wall. A ball with an outer diameter smaller than an inner diameter of the boss is fitted inside the boss' ribs so that it is in contact with the protruding ribs, thus forming a roughly ring-shaped orifice between the ball and the boss. A size of this orifice is set so that a small amount of ink is held as a liquid seal in the orifice by its capillary attraction. The orifice is shaped such that when the negative pressure in the container approaches an allowable limit of the operation range of the print head, the negative pressure overcomes the ink capillary attraction in the orifice, breaking the liquid seal and allowing air to enter into the ink tank through the orifice.

Japanese Patent Application Laid-open No. 6-183023 (1994) discloses another mechanism which comprises a plate with a hole and a plate with a protrusion, both arranged to face each other in an ink bag of resilient sheet, and a spring member arranged between these plates. When the ink bag contracts as a result of a reduction in the remaining volume of ink and the inner negative pressure exceeds a predetermined level, the mechanism causes the protrusion of one plate to fit into the hole of the other plate, thus separating the holed plate from the resilient sheet to allow air to be introduced into the ink bag. With this mechanism, after air is drawn into the ink bag, the holed plate and the resilient sheet are brought into intimate contact with each other, preventing an ink leakage by an ink meniscus or a liquid seal between them.

These methods disclosed in Japanese Patent Application Laid-open Nos. 7-125240(1995), 7-125241(1995) and 6-183023(1994), however, all require a plurality of parts in the air take-in portion, rendering the construction complicated.

Further, if a pressure in the container rises extremely high, as when ambient condition variations occur (e.g., atmospheric pressure fall and temperature rise) after air has entered into the container to some degree, ink may be pushed out of the container. Where the above constructions are applied to an ink jet print head, this phenomenon may result in an ink leakage through ink ejection ports and vent. If a liquid is contained in a bag member of a resilient sheet, some buffer effect may indeed be expected which absorbs a certain range of pressure rise by permitting an air volume expansion due to a pressure reduction, thus alleviating the inner pressure rise. This buffer effect, however, has a limitation.

The construction disclosed in Japanese Patent Application Laid-open Nos. 7-125240(1995) and 7-125241(1995) forms a hermetically closed system through a balance between an ink meniscus force (liquid seal) in a ring-shaped orifice and a negative pressure produced by a spring. Although the mechanical construction is relatively simple, it lacks stability in maintaining the hermetically closed system. That is, the liquid seal may be broken depending on various conditions, leading to a leakage of accommodated ink. These conditions include a pressure difference between the inside and outside of the container, a reduction in ink viscosity due to temperature rise, inadvertent impacts on or fall of the ink tank during handling, and an acceleration to which the ink tank is subjected during a main scan in a serial printing apparatus. Also, since the liquid seal is susceptible to humidity, such as dry air, bubbles may be introduced ununiformly. As such, ink supplying performance of the print head and printing quality are degraded.

To eliminate these problems, the construction of Japanese Patent Application Laid-open Nos. 7-125240(1995) and 7-125241(1995) provides an inlet maze connecting to a boss. The inlet maze is considered to function as an ink overflow container and secure a humidity gradient. The provision of the inlet maze, however, complicates the construction. Further, since the other end of the maze-like path communicates with open air at all times, the ink unavoidably evaporates to some degree through this inlet maze.

There is another problem. When ink in the container is used up, outer air rushes in, eliminating the negative pressure in the container. At this time, the inrush air may cause the ink remaining in the print head to leak out of ink ejection ports or the ink remaining in the container to leak through the ring-shaped orifice in which the meniscus is no longer formed.

Further, in these conventional mechanisms, an opening is provided in the ink tank to directly introduce the atmosphere. When ink in the ink tank is almost running out and a volume of air in the ink tank is larger than that of ink, the introduction of outer air into the ink tank to eliminate the negative pressure may render the maintenance of meniscuses in the ink ejection ports of the print head and in the opening (vent) of the tank incomplete, depending on the size and location of the opening. This in turn may cause an ink leakage and render the introduction of outer air incomplete.

Additionally, depending on a variety of conditions a pressure difference between the inside and outside of the container, temperature variations, impacts on and fall of the ink tank during handling, and, in a serial printing system in particular, an acceleration to which the ink tank is subjected during a main scan the liquid seal in the opening may be broken, resulting in an early introduction of air before the inner pressure reaches a predetermined level or, conversely, a leakage of ink. These conditions change depending on the design of the print head and ink tank and a physical property of ink. It is therefore necessary to optimize the shape, dimension and other designs of the opening and a basic construction of the negative pressure generation mechanism according to a usage of the container.

In addition to these inherent problems, the ink tank using the liquid seal for air introduction has another problem of reducing a degree of freedom of design in the printing apparatus.

That is, it is difficult to form the liquid seal portion separate from the ink tank as required when the liquid seal portion is arranged to be removable from the ink tank. If the liquid seal portion is formed separate from the ink tank, when it is directly mounted on the ink tank or indirectly connected to the ink tank through a tube or the like, complex processing or a special construction considering a pressure difference between the inside and outside of the ink tank is required in order to form a good meniscus in the ring-shaped orifice.

Where the liquid seal portion is provided remote from the ink tank and connected to it through a tube, the tube needs to be filled with ink in order to form a meniscus in the liquid seal portion. The introduction of air through the liquid seal portion forces the ink in the tube back into the ink tank. Refilling the tube with ink after the air introduction requires as complicated a construction or processing as the one described above.

In the construction disclosed in Japanese Patent Application Laid-open No. 6-183023(1994), since air is introduced through a small clearance between a thin plate member and a resilient sheet, a capillary attraction produced by a liquid entering that clearance changes a force required to separate the thin plate and the resilient sheet. As a result, the negative pressure level at which the air introduction is executed may become unstable.

Further, when a pressure of gas (air) in the container increases as the temperature increases, the resilient sheet must be deformed to virtually increase the inner volume of the ink bag to alleviate the increasing inner pressure. Therefore, the resilient sheet member is formed of an easily deformable material with a very low stiffness to provide a sufficient buffer function.

However, low stiffness materials used for such a resilient sheet generally have a small thickness and a high gas permeability, so air can easily pass through it into container due to gas osmolar pressure. Thus, if a liquid is stored in the container for a long period of time, a large volume of gas, so large as cannot be dealt with by a buffer function originally intended to absorb an expanded portion of gas (air) in the container, enters into the container, rendering the buffer function ineffective. It is therefore necessary to use a very expensive material deposited with a metal vapor to meet both of the requirements of a low stiffness and a low gas permeability.

Furthermore, to prevent an ink leakage and a diffusion of ink solvent when a printing apparatus is not printing, Japanese Patent Application Laid-open No. 2002-103642 discloses a construction in which a portion for introducing outer air into the container has a valve structure that can be opened and closed. In this construction, a valve disc is normally closed but, when the container is mounted on the printing apparatus, is opened to communicate the interior of the container with the atmosphere thus assuring a stable supply of ink to the print head. However, in this construction also, when the printing apparatus is not in use (particularly during transportation), the container may take any conceivable attitude, with the result that a liquid comes into contact with the air introduction valve to form a meniscus like a fluid seal, blocking the air introduction, or to form precipitates at the seal portion of the valve disc degrading a reliability of the valve disc operation.

Further, to secure a good sealing ability of the seal portion of the valve disc, the seal portion may be applied a highly viscous liquid such as grease or oil as a sealing material. This sealing material can provide a reliable seal even if the seal portion is scored or has an uneven or rough surface. But if ink is in contact with the seal portion, components of the sealing material dissolve into the ink, changing an ink composition, which will in turn render ink ejections unstable or cause the components of the sealing material in the ink to precipitate at the ink ejection ports, interfering with normal ink ejecting.

In yet another construction disclosed in Japanese Patent Application Laid-open No. 2001-310479, a container mounting lever is installed in a printing apparatus and provided with a valve mechanism which is operated by an external signal to control an opening and closing of an atmosphere introduction port in the container. In this construction, too, there are similar problems to those found in Japanese Patent Application Laid-open No. 2002-103642.

That is, in a construction in which a valve mechanism is provided at the atmosphere introduction port but in which a liquid can enter into the atmosphere introduction port, a liquid comes into contact with the valve disc depending on the attitude of the container or ambient condition variations (vibrations, temperature changes, pressure changes, etc.), degrading the reliability of the valve operation.

IN view of the foregoing, inventors were experienced to know that introduction of air into the liquid container is not preferably in order to eliminate the negative pressure in the container perfectly, whereas it is important to recover the negative pressure to a predetermined value. Also, the inventors determined, for achieving this, an amount of air to be introduced should be an adequate amount.

Particularly when a liquid container is used as an ink tank for directly supplying ink to an ink jet print head, the supply of ink at a stable flow velocity and in a stable flow volume is essential in enhancing a printing speed and image quality. To realize this, it is desired that a resistance which generates as it flows through an ink supply path be kept almost constant. It is therefore important to stabilize the negative pressure in the ink tank and keep it in a predetermined range. This requires components that introduce air into the ink tank to operate reliably.

The present invention has been accomplished with a view to overcoming the aforementioned drawbacks and is intended to realize at least one of the following objectives.

In a liquid container in which an containing portion for containing a liquid (e.g., ink) to be supplied to the outside (e.g., the print head) has a means for generating a predetermined level of negative pressure and an air introduction portion which can introduce air into the containing portion according to an increase in the negative pressure in the containing portion as a result of liquid supply to the outside and thereby maintain the negative pressure in an appropriate range, it is a first object of this invention to provide a construction that can prevent a liquid leakage from the air introduction portion under any environment of use and storage and that can maintain a stable negative pressure characteristic irrespective of a level of liquid consumption.

It is a second object of this invention to provide a liquid container (e.g., ink tank) which performs an introduction of outer air into the liquid container reliably and at an appropriate timing to keep the negative pressure in the container constant and thereby enhance the reliability for the negative pressure stabilization and which prevents a liquid leakage from a liquid supply port in the event of sudden ambient condition variations, ultimately eliminating a wasteful consumption of liquid. The second object also includes providing a liquid using apparatus (e.g., ink jet printing apparatus) using this liquid container.

It is a third object of this invention to provide an ink tank having a negative pressure adjust mechanism which can solve inherent problems of the above-mentioned ink tank using a liquid seal and which can enhance a freedom of design of a printing apparatus. The third object also includes providing an ink jet print head using the ink tank, an ink jet cartridge having the ink jet print head and the ink tank as a unit, and an ink jet printing apparatus with the ink tank.

It is a fourth object of this invention to provide a construction that opens and closes the atmosphere introduction port with a valve disc and which keeps a seal portion of the valve disc out of contact with the liquid to further enhance the sealing performance of the valve disc and assure a stable atmosphere introduction operation and high reliability, whatever attitude the container may take or whatever ambient condition changes may occur.

SUMMARY OF THE INVENTION

To realize the above objectives, a first aspect of this invention provides a liquid container comprising: a liquid containing portion defining a space for containing liquid; a liquid supply portion installed in the liquid containing portion to supply the liquid from the liquid containing portion to a liquid using portion; and a valve to introduce the atmosphere into the liquid containing portion to adjust a negative pressure in the liquid containing portion, the negative pressure being created as the liquid in the liquid containing portion is consumed; wherein the valve can be closed by pressing its valve disc against a seal member; wherein the liquid container further includes a closing member installed in a path, the path establishing a communication between a seal portion at which the valve disc and the seal member contact each other and the liquid containing portion, the closing member being capable of enabling or disabling the communication through the path.

The liquid container may have a valve chamber in which the valve is installed, and a communication path connecting the valve chamber with the liquid containing portion, the communication path being closed by the closing member. In this case, when the liquid container is connected to the liquid using portion that consumes the liquid from the liquid containing space, the communication path may be opened by the closing member to enable a communication between the valve chamber and the liquid container.

Further, a liquid using apparatus is provided which is connectable to the liquid container of the first aspect to consume the liquid supplied from the liquid containing space.

Further, a printing apparatus is provided which has a means for performing printing by using the liquid using apparatus in the form of a print head, the print head being adapted to perform printing by using ink supplied from the liquid container that contains ink as the liquid.

Further, an ink jet head cartridge is provided which has an ink jet print head for ejecting ink and the liquid container of the first aspect for storing ink to be supplied to the ink jet print head as the liquid.

A second aspect of this invention provides a liquid container in which, when the liquid container is connected to the liquid using portion, the closing member is open and in which, when the liquid container is removed from the liquid using portion, the closing member closes the communication path again. In this case, the closing member may be formed of a rubber material having a slit or formed of a check valve.

A third aspect of this invention provides a liquid container in which the closing member is opened by an operation of that mechanism arranged in the liquid containing space which has a function of maintaining or expanding a volume of the liquid containing space.

A further aspect of this invention provides a liquid container in which the closing member is formed integral with a packaging material that packages the liquid container so that, in a process of removing the packaging material, the closing member is opened.

A further aspect of this invention provides a liquid container in which the closing member closes an atmosphere introduction port formed in the valve disc.

In the above, the ink as the liquid may include a pigment as a color material.

With this invention or various aspects thereof, or a variety of embodiments described above, the aforementioned objects can be attained. That is, at least one of the following advantages can be realized.

With the construction which has arranged in an containing portion for containing a liquid (such as ink) to be supplied to the outside (such as a print head) a means for generating a desired level of negative pressure and an air introduction portion which introduces air into the container according to an increase in the negative pressure in the liquid containing portion as a result of liquid supply to the outside and thereby keeps the negative pressure in an appropriate range, it is possible not only to prevent a leakage of liquid such as ink from the air introduction portion under any environment of use and storage but also to maintain a stable negative pressure characteristic without regard to the level of liquid consumption. Further, since a volumetric efficiency is high and the ink supply is effected smoothly, the application of this construction to an ink jet printing system will contribute to a stable quality of printed images, a compact design and other advantages.

Since the one-way valve—which permits a flow of gas in one direction and blocks a flow of fluid (liquid and gas) in the opposite direction to introduce a gas to adjust a pressure in an ink tank or liquid container—can be installed separate from the ink tank, it is possible to determine a position at which to install the one-way valve without any restrictions imposed by the position of the ink tank.

As a result, a negative pressure adjust mechanism of the ink tank can be obtained. The negative pressure adjust mechanism of the ink tank can improve a freedom of design of the ink jet printing apparatus and others.

It is possible to supply ink contained from the ink tank to the ink jet head while maintaining a stable negative pressure until the ink tank runs out of ink. Further, since the hermetically enclosing member flexibly contracts or expands or moves along with a movable member, an ink leakage can be prevented even in the event of an ink tank expansion caused by ambient condition variations, such as temperature rise and atmospheric pressure fall.

Further, this invention can achieve the above features with a reduced number of parts, and providing the atmosphere introduction port in a part of the movable member allows for a stable introduction of atmosphere.

This in turn assures a stable characteristic in the ink ejection from the ink jet head at all times. Since a wasteful consumption of ink is avoided, running cost can be reduced.

The use of the open-close mechanism that introduces outer air into the container when the negative pressure in the container exceeds a predetermined level can keep the interior of the container at a desired negative pressure level, assuring a stable supply of liquid. The open-close mechanism may employ a valve structure that operates according to a pressure difference.

The interior of the container can be maintained at a stable, predetermined level of negative pressure until the ink in the container is consumed almost completely. This enables a stable supply of ink to the printing apparatus, eliminates a wasteful consumption of ink and lowers the running cost.

The liquid (such as ink) in the liquid container can be supplied to the outside at an appropriate, stable negative pressure without unduly increasing the internal negative pressure until the liquid in the container is fully consumed. Also, since the air introduction to alleviate the negative pressure in the liquid container can be performed at a proper timing, a value setting the negative pressure for a predetermined value can be achieved easily considering a variety of conditions, resulting in a highly reliable and stable value setting of negative pressure. Since the movable member to which a force is applied to generate a negative pressure and the member that opens and closes an air introduction opening are controlled by an elastic member, an expansion of a gas introduced into the liquid container, which may be caused by ambient condition variations such as temperature rise and atmospheric pressure fall, can be absorbed, preventing an inadvertent liquid leakage. Further, since the outer air introduction is initiated only after the movable member is displaced a predetermined distance from the initial position where the liquid is not yet delivered and since a volume corresponding to that displacement functions as a buffer space, a pressure rise resulting from ambient condition variations can be alleviated, which in turn reliably prevents a liquid leakage from an ink ejection portion of a device to which the liquid has been delivered (such as ink ejection ports of an ink jet print head). This in turn avoids a wasteful consumption of liquid and contributes to a reduction in the running cost. This invention realizes these features and effects with a reduced number of parts.

Further, since the communication path that communicates the valve chamber, in which the one-way valve is installed, to the ink containing chamber can be closed, a possibility can be eliminated that the sealing performance of the one-way valve may be degraded by the ink entering into the valve chamber during transport because the ink tank attitude cannot be controlled. Therefore, an improved stability in valve operation is ensured.

In addition, this invention, when applied to an ink jet print head, can produce a stable ink ejection characteristic at all times, contributing to a stabilized and improved print quality.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Incidentally, hereafter, the word "print" (hereinafter, referred to as "record" also) represents not only forming of significant information, such as characters, graphic image or the like but also represent to form image, patterns and the like on the printing medium irrespective whether it is significant or not and whether the formed image elicited to be visually perceptible or not, in broad sense, and further includes the case where the medium is processed.

Here, the wording "printing medium" represents not only paper to typically used in the printing apparatus but also cloth, plastic film, metal plate and the like and any substance which can accept the ink in broad sense.

Furthermore, the wording "ink" has to be understood in broad sense similarly to the definition of "print" and should include any liquid to be used for formation of image patterns and the like by being applied to a print medium, for processing of the printing medium or for treating an ink (e.g., coagulating or insolubilizing a color materials in ink applied to the print medium).

Now, this invention will be described in detail by referring to the accompanying drawings.

In the following, some embodiments will be taken up in which the invention is applied to an ink jet printing apparatus. That is, a liquid container contains ink to be supplied to an ink jet print head and thus the word "liquid" may also be expressed as "ink." This invention is particularly advantageous when applied to inks including color materials. For ink having pigment as its component, this invention is more advantageous because it can secure a better ink supply capability.

First Embodiment

FIGS. 1 to 4 show a first embodiment as a basic construction of this invention.

Figure 1:
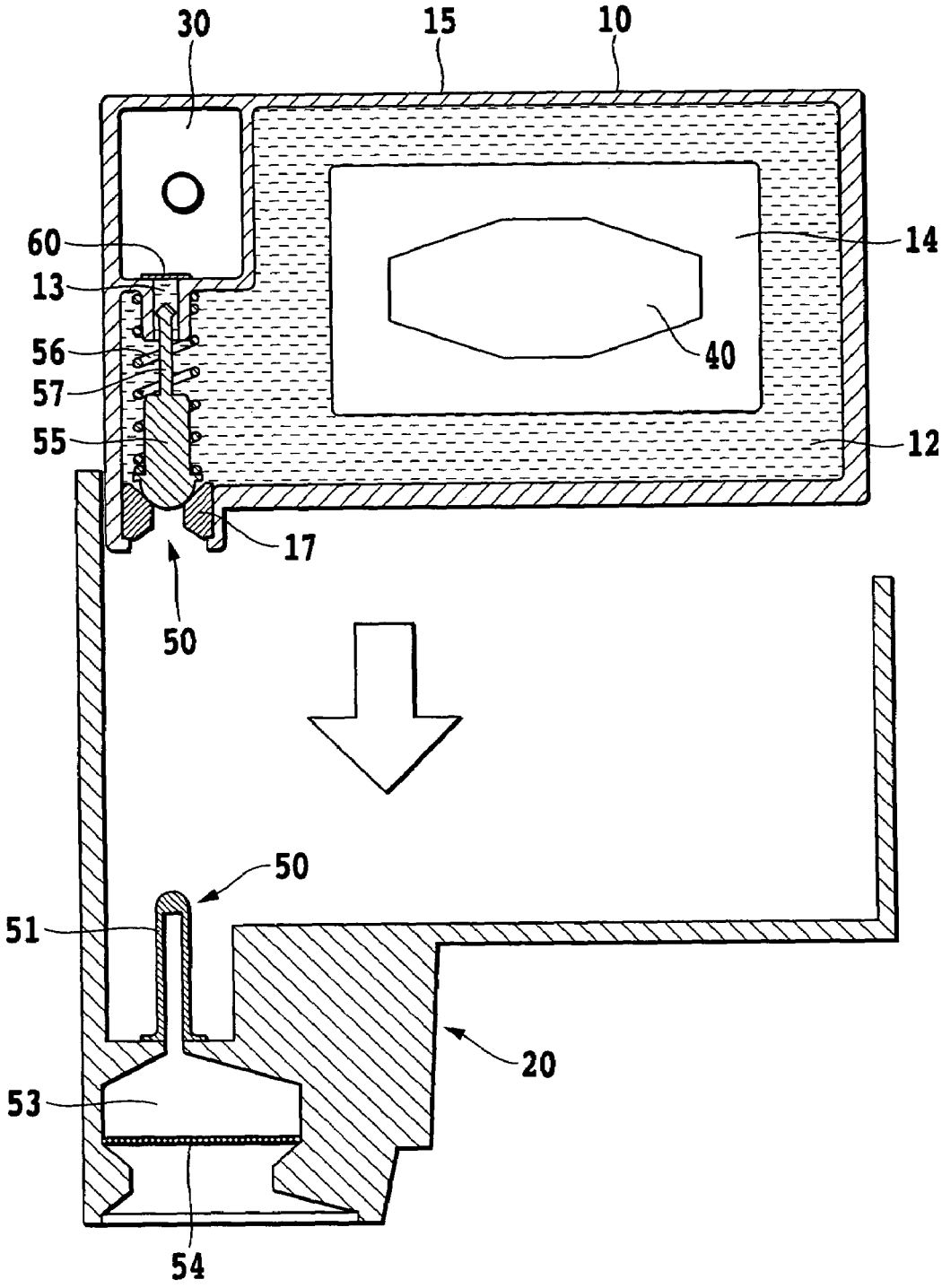
FIG. 1 is a schematic cross-sectional view of an ink tank and a print head according to a first embodiment of this invention.

FIG. 1 is a cross section showing an outline of a liquid container and an ink jet print head according to the first embodiment of this invention.

An ink supply system of this invention shown in FIG. 1 generally has an ink tank 10 as a liquid container, an ink jet print head (simply referred to as a "print head") 20, and a liquid supply unit 50 forming an ink supply path connecting the ink tank and the print head. The liquid supply unit 50 may be formed disconnectable from or inseparably integral with the print head 20. The liquid supply unit 50 may also be provided on a carriage (not shown) that mounts the print head 20, with the ink tank 10 removably mounted from above on the carriage, and may be so constructed as to establish an ink supply path from the ink tank 10 to the print head 20 when the ink tank is mounted.

The ink tank 10 generally comprises two chambers, an ink containing chamber 12 as a liquid containing portion that defines an ink containing space and a valve chamber 30 in which a one-way valve is installed. The ink containing chamber 12 and the valve chamber 30 are connected with each other through a communication path 13. In a process of manufacturing the ink tank 10, a film-like communication path closing member 60 is provided in the communication path 13 to block the communication between the ink containing chamber 12 and the valve chamber 30. The ink containing chamber 12 contains ink for ejecting from the print head. Ink is supplied from the ink containing chamber 12 to the print head 20 as an ink ejecting operation is performed. The communication path closing member 60 blocks ink contained in the ink containing chamber 12 from entering into the valve chamber 30, which therefore contains only a gas.

Figure 2:
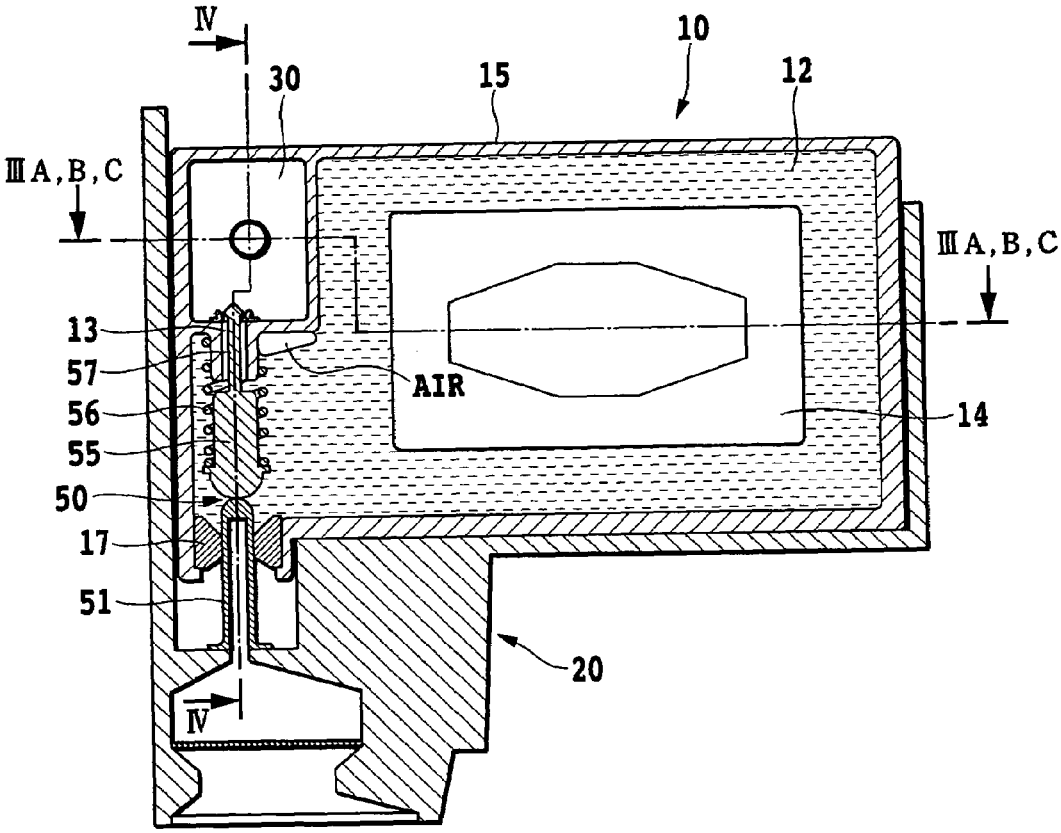
FIG. 2 is a schematic cross-sectional view showing the ink tank mounted on the print head in the first embodiment of the invention.
Figure 4:
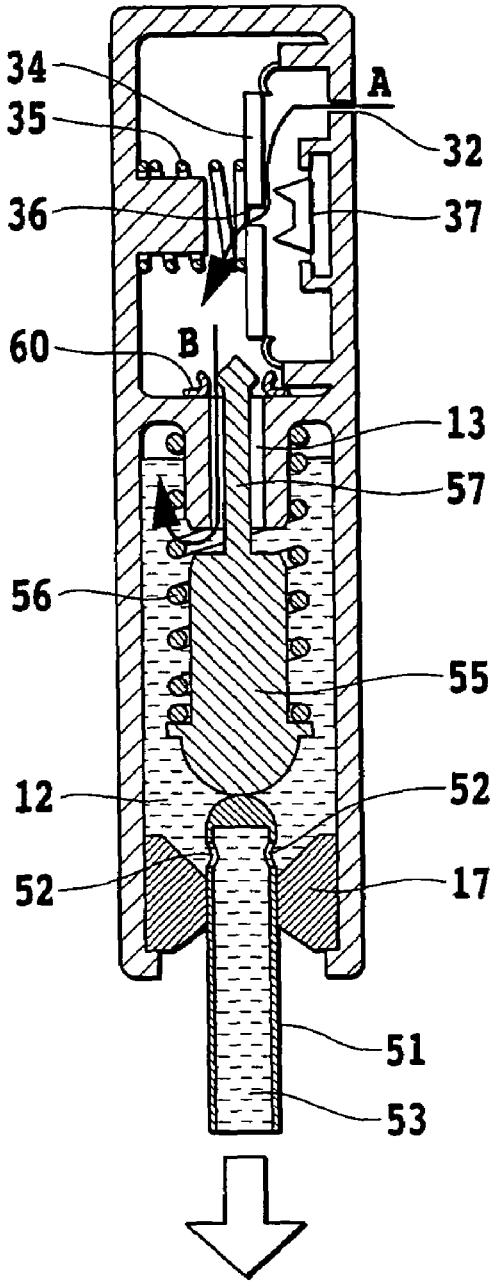
FIG. 4 is a cross-sectional view taken along the line A—A of FIG. 2 showing an air flow.

A connection between the print head 20 and the ink tank 10 is established by a connection pipe 51 formed integral with the print head 20 being inserted into the ink tank 10, the connection pipe 51 constituting the liquid supply unit 50, as shown in FIG. 2. A top end of the connection pipe 51, as shown in FIG. 4, is closed and, when the print head 20 and the ink tank 10 are connected, contacts a connection closing member 55 described later and pushes the connection closing member 55 up as the connection pipe 51 is further inserted. The connection pipe 51 has supply holes 52 formed in a sidewall near the top end thereof and connects to an ink supply path 53 communicating to ink ejection ports of the print head 20. The insertion of the connection pipe 51 into the ink tank 10 brings the print head 20 into fluidal connection with the ink tank 10, allowing ink to be supplied to the print head 20. Denoted 54 is a filter provided in the ink supply path 53.

An opening in the ink tank 10 into which the connection pipe 51 is inserted is fitted with a seal member 17, such as rubber, which forms the liquid supply unit 50. The seal member 17 intimately fits over a circumferential surface of the connection pipe 51 to prevent an ink leakage from the ink tank 10 and secures a firm connection between the connection pipe 51 and the ink tank 10. When the print head 20 and the ink tank 10 are not connected, the connection closing member 55 biased by a connection spring 56 as a bias means is pressed against the seal member 17 to prevent an ink leakage.

As shown in the FIG. 1, 2 and 4, a needle-like rod 57 extends-vertically upward from an upper end (an end opposite a lower end that engages or contacts the seal member 17 and the connection pipe 51) of the connection closing member 55. A free end of the needle-like rod 57 is sharp. The free end of the needle-like rod 57 situated to match the communication path 13 communicating the valve chamber 30 with the ink containing chamber 12 so that it can move up or down in the communication path 13 as the connection closing member 55 moves vertically.

FIG. 2 shows a state in which the ink tank 10 is connected with the print head 20. In this state, the connection closing member 55 engages the top end of the connection pipe 51 and is pushed upward in the figure as the connection pipe 51 moves into the ink tank 10. As described above, when the top end of the connection pipe 51 including the supply holes 52 is inserted into the ink tank 10, the print head 20 is fluidally communicated with the ink tank 10. At this point, the needle-like rod 57 extending upward from the upper end of the connection closing member 55 is inserted into the communication path 13 until the rod 57 breaks the communication path closing member 60, at which time the ink containing chamber 12 comes into communication with the valve chamber 30.

As can be seen from above, with the ink tank 10 mounted and secured to the print head 20, the needle-like rod 57 of the connection closing member 55 needs to be long enough to pass through the communication path 13 and break or puncture the communication path closing member 60. In order to puncture the communication path closing member 60 that closes the path 13 between the ink containing chamber 12 and the valve chamber 30, it is understood that a distance that the connection pipe 51 pushes up the connection closing member 55 needs to be set greater than an initial distance shown in FIG. 1 between the free end of the needle-like rod 57 and the communication path closing member 60.

Although it is preferred that the free end of the needle-like rod 57 of the connection closing member 55 be designed to be preliminarily located within the communication path 13, as shown in the figure, other construction may be employed. Further, while the lower end of the connection closing member 55 that engages the connection pipe 51 is formed convex in this embodiment, it may be formed concave. In that case, the concave surface preferably has a larger radius of curvature than a convex surface of the top end of the connection pipe 51. This arrangement stabilizes the action of the connection pipe 51 pushing up the connection closing member 55.

In the vicinity of the free end of the needle-like rod 57, its periphery may be protruded perpendicular to an axis of the rod 57 as shown. Therefore, when the needle-like rod 57 moves through the communication path 13, it can move roughly along a center line of the communication path 13. The needle-like rod 57 has a smaller outer diameter than an inner diameter of the communication path 13. When the ink tank 10 is secured to the print head 20, the needle-like rod 57 is held concentric with the communication path 13, with a gap or a space formed between them, assuring a reliable communication between the valve chamber 30 and the ink containing chamber 12.

The communication path closing member 60 is formed of a film material. The film material preferably has a strength such that it can be broken with as small a force as possible and can still keep closing the communication path before being punctured. While the communication path closing member 60 is formed to be broken in this embodiment, it may be formed otherwise. For instance, it may have a check valve structure, as in a third embodiment described later (see FIGS. 6A and 6B).

Figure 3A:
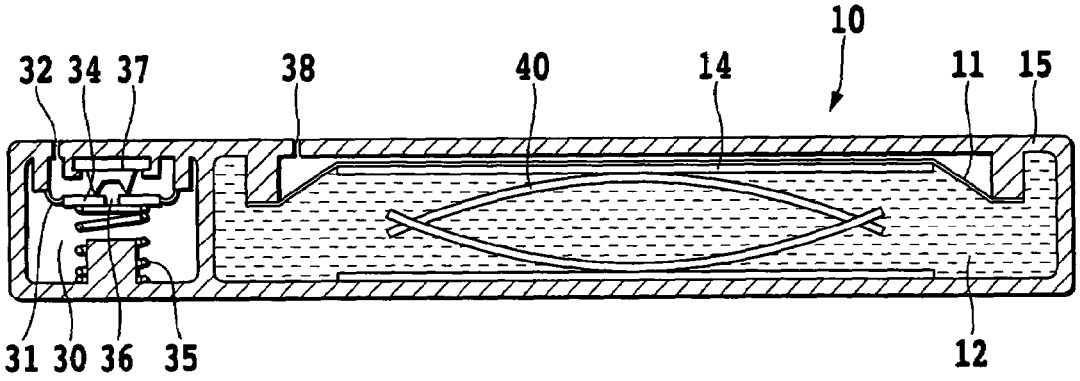
FIGS. 3A, 3B and 3C are cross-sectional views taken along the line B—B of FIG. 2 showing an operation of a one-way valve, FIG. 3A representing a state in which ink has been consumed to some degree, FIG. 3B representing a state in which, after ink consumption has proceeded, a sheet member is deformed to its capacity, FIG. 3C representing a state in which ink consumption has proceeded further.
Figure 3B:
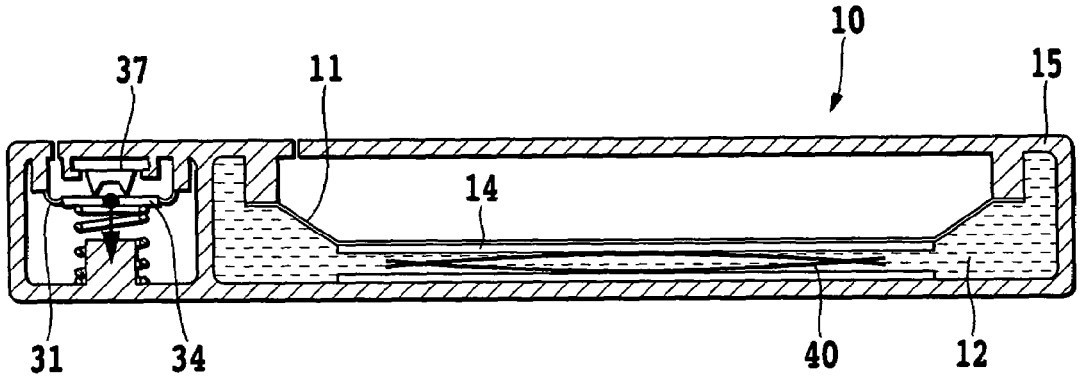
Figure 3C:
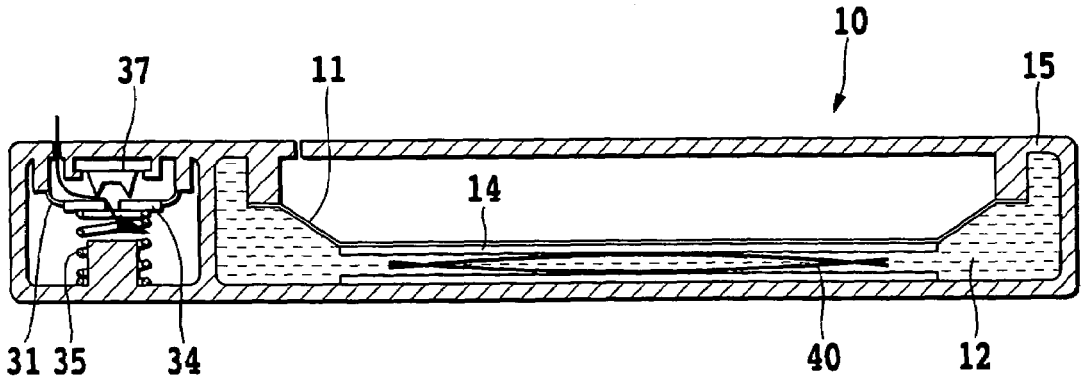

Next, we will describe how members in the ink containing chamber and a one-way valve operate as ink is supplied from the ink tank 10 to the print head 20. FIGS. 3A to 3C are conceptual cross-sectional views taken along the line IIIA, B, C-IIIA, B, C of FIG. 2.

In a part of the ink containing chamber 12 is arranged a sheet member (flexible film) 11 as a movable portion which is deformable. Between the sheet member 11 and a rigid enclosure 15 is defined an ink containing space. A space in the enclosure 15 situated on the outer side of the sheet member 11 when viewed from the ink containing space, i.e., a space above the sheet member 11 in FIGS. 3A to 3C, is open to the atmosphere through an atmosphere communication hole 38 and thus is under a pressure equal to the atmospheric pressure. Further, the ink containing space forms a virtually hermetically closed space except for the seal member 17 which serves as a connection portion, the connection portion constructing the liquid supply unit 50 provided below the ink containing space, as viewed in FIG. 1.

In this embodiment, a central portion of the sheet member 11 is restrained in shape by a pressure plate 14 or a flat plate support member, with a peripheral portion of the sheet member 11 deformable. The sheet member 11 has initially its central portion raised with its peripheral portion trailing down like an isosceles trapezoid when seen from the side, as shown in FIG. 3A. This sheet member 11 deforms as an ink volume and a pressure in the ink containing space change, as described later. At this time the peripheral portion of the sheet member 11 flexibly deforms with good balance allowing the central portion 14 of the sheet member 11 to translationally move up or down while keeping its almost horizontal attitude. Since the sheet member 11 deforms (or moves) smoothly, no impacts are produced by the deformation, nor any abnormal pressure variations due to such impacts occur in the ink containing space.

In the ink containing space there is a spring member 40 in the form of a compression spring that urges the sheet member 11 outward through the pressure plate 14. An urging force of the spring member 40 generates a negative pressure in a range which balances with a retaining force of meniscuses formed in ink ejection ports of the print head and still allows an ink ejection operation of the print head. FIG. 3A represents a state in which the ink containing chamber 12 as an ink containing space is filled with ink almost to its capacity. In this state ink is already consumed to some degree from an initial state in which the ink containing chamber 12 of the ink tank 10 is fully loaded. In this state the spring member 40 is already compressed and an appropriate level of negative pressure is present in the ink containing space.

In the valve chamber 30 there is provided a one-way valve which introduces a gas (air) from outside when the negative pressure in the ink tank 10 exceeds a predetermined level and also prevents an ink leakage from the ink tank 10. The one-way valve comprises a pressure plate 34 as a valve disc or a valve closing member formed with a communication port 36 that acts as an atmosphere introducing port for introducing outer air; a seal member 37 fixedly mounted on an inner wall of an enclosure forming the valve chamber 30 and located at a position opposing the communication port 36 to hermetically close the communication port 36; and a sheet member 31 joined to the pressure plate 34 and having the communication port 36 piercing therethrough. The valve chamber 30 also maintains a virtually hermetically closed space excluding the communication path 13 to the ink tank 10 and the communication port 36 to the atmosphere. A space in the enclosure of the valve chamber 30 situated on the outer side of the sheet member 31 when viewed from the hermetically closed space is open to the atmosphere through an atmosphere communication hole 32 and thus is under atmospheric pressure.

The sheet member 31 is deformable in its peripheral portion, except for its central portion joined to the pressure plate 34, to allow for a smooth vertical movement in the figure of the pressure plate 34 as the valve disc or the valve closing member.

In the valve chamber 30 is installed a spring member 35 as a valve restraining member to restrain an opening action of the valve. The spring member 35, in this case too, is held slightly compressed to push the pressure plate 34 upward in the figure by a reactionary force of the spring compression. The compression and expansion of the spring member 35 provides a valve function by causing the seal member 37 to closely contact with and separate from the communication port 36. These members are combined to form a one-way valve which allows only an introduction of a gas from the atmosphere communication hole 32 through the communication port 36 into the interior of the valve chamber 30.

The seal member 37 needs only to hermetically and reliably close the communication port 36. That is, the seal member 37 may be formed so that an area of the seal member 37 in contact with the communication port 36 is planar with respect to an opening surface; it may have a rib that can be put into intimate contact with the circumference of the communication port 36; or it may be provided with a protrusion that fits into the communication port 36 to close it. All that is required of the seal member 37 is an ability to make an intimate contact with the communication port 36, and there is no limitation on the material of the seal member. However, since the hermetic contact is achieved by the expansion force of the spring member 35, it is more preferred that the seal member 37 be formed of an elastic, contractible material, such as rubber, that can easily follow the movement of the sheet member 31 and the pressure plate 34 driven by the expansion force of the spring member 35.

FIG. 3B shows a state in which the sheet member 11 is displaced down (in a direction that compresses the spring member 40) after the ink consumption has progressed from the state of FIG. 3A in which the ink was consumed only slightly. In this state of FIG. 3B, the free downward displacement of the sheet member 11 is maximum and, if the ink consumption continues further, the resilient film of the sheet member 11 is tensed and loaded further by the spring member 40, increasing the negative pressure in the ink containing chamber 12. When the negative pressure in the ink containing chamber 12 exceeds a predetermined air introduction pressure (also referred to as an air introduction negative pressure) determined by the one-way valve, the communication port 36 forming the one-way valve opens to introduce outer air into the valve chamber 30, as shown in FIG. 3C. The air thus introduced is further led through the communication path 13 into the ink containing chamber 12 (see FIG. 4). The pressure in the ink containing chamber 12 is prevented from falling below the predetermined air introduction pressure but maintained at a constant pressure. As a result of this introduction of air, the inner volume of the ink tank 10 increases because the sheet member 11 and the pressure plate 14 are allowed to move up. At the same time, as the negative pressure decreases, the communication port 36 is closed. Therefore, the print head 20 can be provided with a stable supply of ink and the printing operation performed as desired. The ink tank of the above construction is preferable in implementing this invention more effectively.

Referring to FIG. 4, the air introduction process will be explained in more detail. FIG. 4 represents an IV—IV cross section of FIG. 2. The ink tank 10 in FIG. 4 is in a state in which the negative pressure in the ink containing chamber 12 has reached the predetermined air introduction pressure as shown in FIG. 3C and outer air is being introduced. The valve chamber 30 and the ink containing chamber 12 are communicated through the communication path 13, with the communication path closing member 60 punctured by the needle-like rod 57 of the connection closing member 55, and thus have the same pressure. Forces acting on the pressure plate 34 are a force generated by a pressure difference between the pressure (negative pressure) in the valve chamber 30 and the atmospheric pressure and a pressing force of the spring member 35 in the valve chamber 30. A balance between these forces determines the air introduction pressure. In the state of FIG. 4, the force generated by the pressure difference is greater than the pressing force of the spring member 35 in the valve chamber 30, so the pressure plate 34 is displaced to the left in the figure. Thus, a gap is formed between the seal member 37 and the pressure plate 34, opening the communication port 36, through which air is introduced as indicated by an arrow A. The air introduced into the valve chamber 30 is further led through a gap between the needle-like rod 57 of the connection closing member 55 and the communication path 13 into the ink containing chamber 12 (as indicated by an arrow B). The air thus introduced. alleviates the negative pressure in the ink containing chamber 12, reversing the pressure balance to close the one-way valve. In this way, the negative pressure in the ink containing chamber 12 is stably controlled and kept constant, assuring a stable supply of ink.

If ambient condition variations such as temperature rise and atmospheric pressure fall should occur, this construction can alleviate a pressure rise in the ink tank due to ambient condition variations and effectively prevent a possible ink leakage from ink ejection ports because the air taken into the ink containing space is allowed to expand to as large as a volume difference between the maximum displaced bottom position of the sheet member 11 and pressure plate 14 (FIG. 3C) and the initial position (FIG. 3A), i.e., because the space of this volume difference works as a buffer.

Further, no outer air is introduced until the inner volume of the ink containing space decreases from the initial fully loaded state as the liquid or ink is delivered and a buffer space is secured. Thus, if sharp ambient condition changes occur or the ink tank is subjected to vibrations or fell during handling, no ink leakage will result. Further, since the buffer is not secured in advance before ink begins to be consumed, the ink container has a high volumetric efficiency and can be formed compact.

In the example of FIG. 3A, while the spring member 40 in the ink containing chamber 12 is shown to be constructed as a combination of paired leaf spring members, U-shaped in cross section and arranged so that their U-shaped open sides face each other, other forms of springs can also be employed. For example, it may be a coil spring or a conical coiled spring. Further, the spring member 35 in the valve chamber 30 can also use other elastic members than the coil spring.

Now, a state of the ink tank 10 immediately after it is connected, from the state of FIG. 1, to the print head 20 will be detailed in the following.

In the state of FIG. 1, the ink tank 10 is not yet connected to the print head 20 and thus the valve chamber 30 is isolated from the ink containing chamber 12 by the communication path closing member 60. In this state also, the spring member 40 is in a compressed state, as described above, and the ink containing chamber 12 maintains a negative pressure. The valve chamber 30 preferably has an atmospheric pressure or a smaller negative pressure (i.e., higher pressure) than that of the ink containing chamber 12. This is explained as follows. When the connection closing member 55 punctures the communication path closing member 60, communicating the valve chamber 30 with the ink containing chamber 12, the lower negative pressure (higher pressure) in the valve chamber 30 causes air to move from the valve chamber 30 to the ink containing chamber 12 immediately after the puncture, equalizing the pressures in these chambers. This prevents ink from flowing into the valve chamber 30 immediately after the puncture.

With the above arrangement, an ingress of ink into the valve chamber can be prevented if the ink tank 10 takes any conceivable attitude during a transportation period after the ink tank 10 has been manufactured until it is mounted on the print head 20. This in turn can prevent variations in a responsiveness of the open/close operation of the one-way valve which are caused by the ink arriving in the vicinity of the seal member 37, and can also avoid a degradation of a sealing performance of the seal member 37 and the pressure plate 34 that would result from ink precipitates.

Further, the higher pressure in the valve chamber 30 than in the ink containing chamber 12 can prevent an inflow of ink into the valve chamber 30 immediately after the communication path closing member 60 is broken.

Second Embodiment

Figure 5:
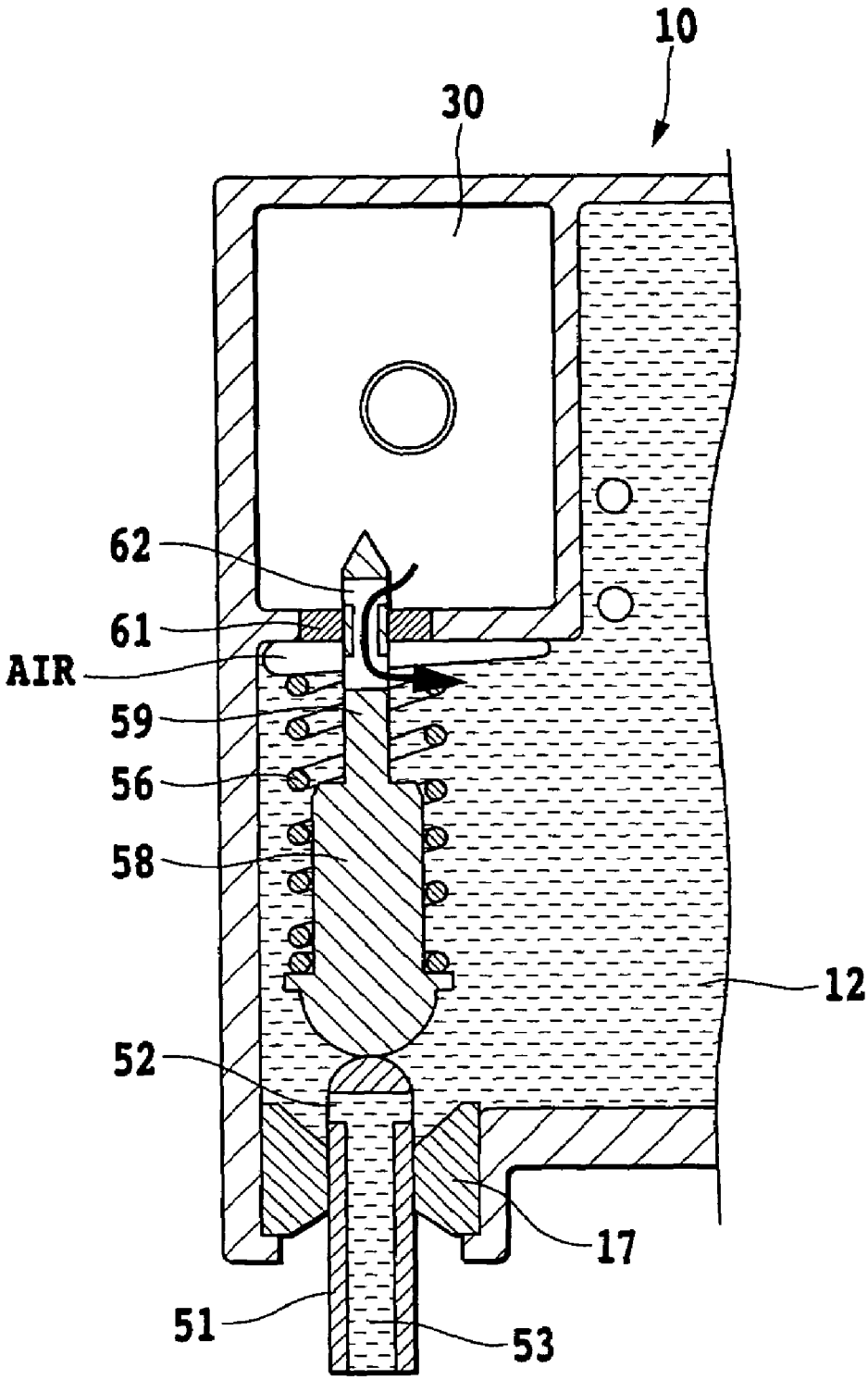
FIG. 5 is an enlarged cross-sectional view showing a second embodiment of the invention.

FIG. 5 is a conceptual cross-sectional view of a second embodiment of this invention.

This embodiment differs from the first embodiment in that a needle-like rod 59 of a connection closing member 58 is formed in a hollow rod to provide a communication path 62 and that a communication path closing member is formed as a slit rubber 61 which is made of a rubber material and has a slit at its center. In this construction too, when a connection pipe 51 of a liquid supply unit 50 displaces the connection closing member 58 upward in the figure, the ink tank 10 and the print head 20 is fluidally connected with each other. Then, the hollow needle-like rod 59 of the connection closing member 58 is inserted into the slit rubber 61—which thus far has isolated the valve chamber 30 from the ink containing chamber 12—brining the valve chamber 30 into communication with the ink containing chamber 12 through the communication path 62 in the hollow needle-like rod 59. Although the communication path 62 in this embodiment is shaped like a letter I, other structures may be used. What is required of this communication path 62 is that, when the free end of the hollow needle-like rod 59 passes through the slit rubber 61 into the valve chamber 30, the communication path 62 must be able to connect the valve chamber 30 with the ink containing chamber 12. The communication path 62 may, for example, be formed like an inverted letter T.

The air introduction process in this embodiment is similar to that of the first embodiment. That is, as ink is supplied and the spring member 40 is deformed, the negative pressure in the ink containing chamber 12 increases. When the negative pressure reaches an air introduction pressure that is determined by a pressing force of the spring member 35 forming the one-way valve in the valve chamber 30 and by a force generated by a differential pressure acting on the pressure plate 34 in the valve chamber 30, outer air is introduced through the communication port 36, thus alleviating the negative pressure in the ink containing chamber 12 and keeping the negative pressure constant.

Further, in this embodiment even if the ink tank 10 is disconnected from the print head 20 while the ink tank is in use, the communication between the valve chamber 30 and the ink containing chamber 12 is automatically interrupted. As the connection closing member 58 closes the seal member 17 of the liquid supply unit 50, the hollow needle-like rod 59 is drawn out of the slit rubber 61 which then closes its slit, thus isolating the valve chamber 30 from the ink containing chamber 12. This arrangement prevents ink from getting into the valve chamber 30 even if the ink tank is taken out while in use, thus securing a perfect sealing reliability of the valve chamber 30.

Third Embodiment

Figure 6A:
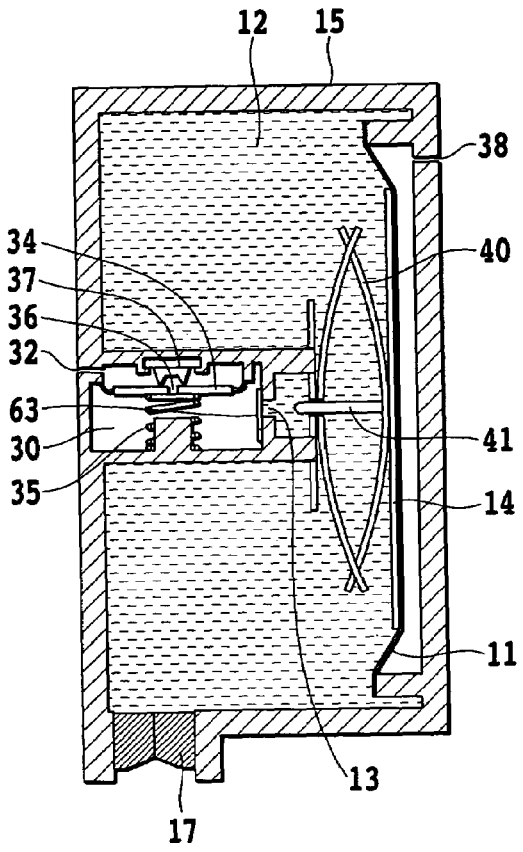
FIGS. 6A and 6B are schematic cross-sectional views showing an ink tank according to a third embodiment of the invention, FIG. 6A representing a state in which ink has been consumed to some degree, FIG. 6B representing a state in which the ink consumption has progressed further.
Figure 6B:
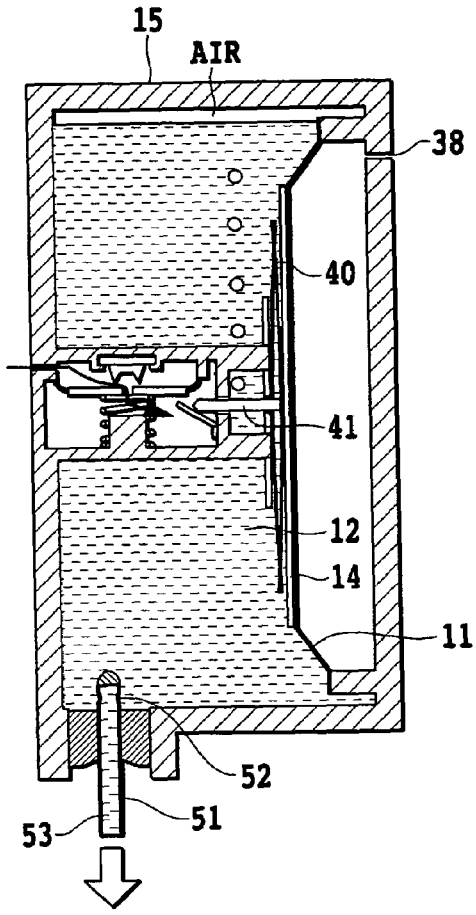

FIGS. 6A and 6B are conceptual cross-sectional views of a third embodiment of this invention.

In this embodiment, as shown the figure, a valve chamber 30 is arranged in a central part of the ink tank 10 and a communication path 13 connecting the valve chamber 30 to the ink containing chamber 12 is situated on a side surface of the valve chamber 30. In this embodiment, the valve chamber 30 is isolated from the ink containing chamber 12 by a film-like check valve 63, which was suggested in the first embodiment. As can be seen from FIGS. 6A and 6B, the check valve 63 is so constructed as to open only from the ink containing chamber 12 side toward the valve chamber 30 side. Further, the pressure plate 14 is provided with a needle-like rod 41 at a position corresponding to the communication path 13. The seal member 17 is formed of a rubber material having a slit, into which the connection pipe 51 of the liquid supply unit 50 is inserted. The seal member 17 does not require a connection closing member like the one used in the first and second embodiment.

FIG. 6B represents a state reached after ink of FIG. 6A is supplied to the print head.

As in the previous embodiments, as ink is supplied from the ink tank, the pressure plate 14 is displaced to the left in the figure, securing a buffer space. At the same time, the needle-like rod 41 progressively approaches the communication path 13. As the ink supply continues and the pressure plate 14 is displaced further, the needle-like rod 41 pushes the check valve 63 open, bringing the valve chamber 30 into communication with the ink containing chamber 12. In this embodiment, because of the aforementioned structure of the check valve 63, only when the needle-like rod 41 pushes the check valve 63, is the valve chamber 30 communicated to the ink containing chamber 12. When the valve chamber 30 communicates with the ink containing chamber 12 for the first time, since the valve chamber 30 has a higher pressure than that of the ink containing chamber 12, air moves from the valve chamber 30 into the ink containing chamber 12, alleviating the negative pressure in the ink containing chamber 12, as in the first embodiment. This in turn allows the pressure plate 14 to move back toward the right in the figure. Depending on the distance that the pressure plate 14 has moved back, the check valve 63 may be closed again. In that case, as the ink supply proceeds and the pressure plate 14 is displaced to the left, the needle-like rod 41 opens the check valve 63 again. When the negative pressure increases further and exceeds the air introduction negative pressure determined by the one-way valve, the pressure plate 34 of the valve chamber 30 is displaced to introduce air.

Since the communication between the valve chamber 30 and the ink containing chamber 12 is established and interrupted without using the connection closing member, this embodiment has an advantage of being able to reduce the number of parts and therefore cost, when compared with the first and second embodiment. Further, since the formation of the buffer space and the valve opening action are perfectly synchronized, even if the interior of the valve chamber 30 is exposed to the atmosphere in the event of an accident, such as breakage, the ink containing chamber 12 can maintain a minimum level of negative pressure by the action of the check valve 63, thus preventing a possible ink leakage.

Further, the check valve structure of this embodiment can be used in the first embodiment as described above. This is more preferable because, when the ink tank is disconnected from the print head, the communication between the valve chamber and the ink containing chamber is always interrupted. It is of course possible to use in this embodiment the film-like connection closing member of the first embodiment.

Fourth Embodiment

Figure 8A:
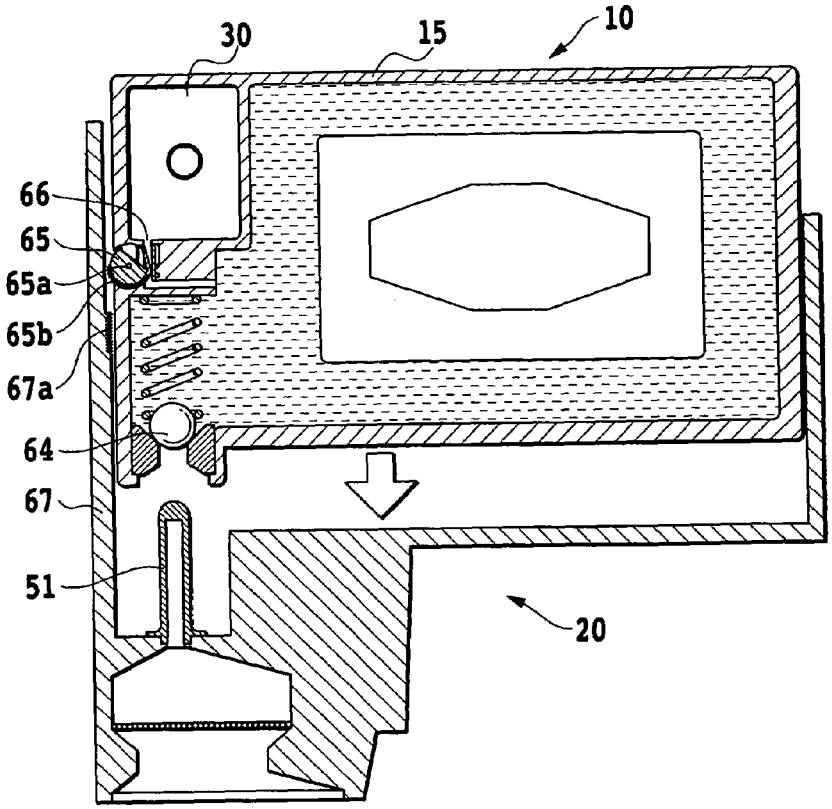
FIGS. 8A and 8B are schematic cross-sectional views showing an ink tank and a print head according to a fourth embodiment of the invention, FIG. 8A representing a state immediately before the ink tank is mounted on the print head, FIG. 8B representing a state after the ink tank has been mounted on the print head.
Figure 8B:
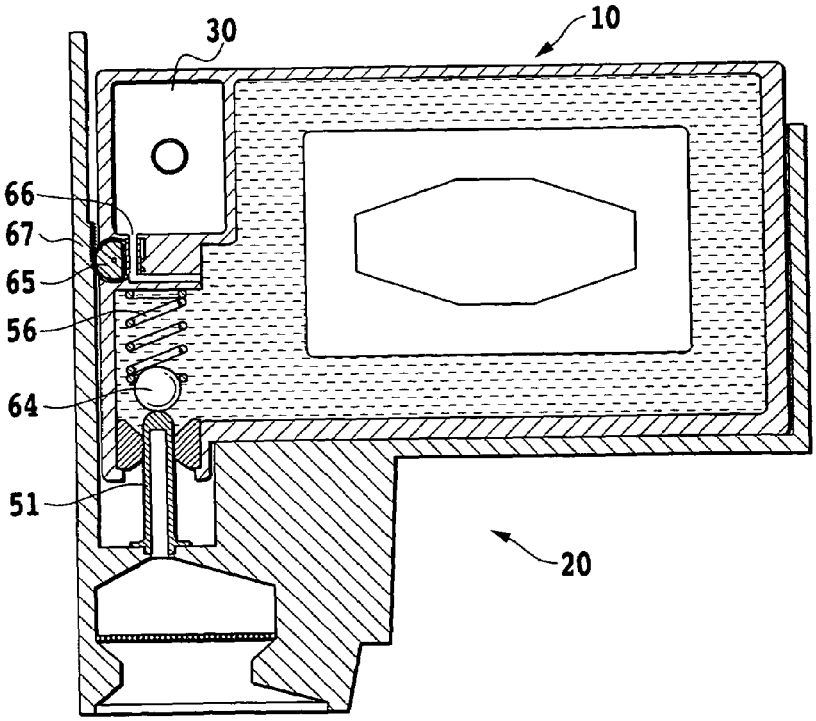

FIGS. 8A and 8B are conceptual cross-sectional views of a fourth embodiment of this invention, FIG. 8A representing a state immediately before the ink tank 10 is mounted on the print head 20, FIG. 8B representing a state in which the ink tank 10 is mounted on the print head 20.

This embodiment is characterized in that at least a part of a wall forming a communication path 66 is formed of an elastic member, such as rubber. This allows the communication path 66 to be opened and closed by a member installed the rigid enclosure 15 of the ink tank 10 and kept out of contact with ink, such as a cam 65, rather than by a member with a possibility of coming into contact with ink in the ink tank. The cam 65 in this embodiment is shaped like a circular disc with one portion cut away and with a remaining arc portion formed with teeth (pinion) 65*b*, as shown. The cam 65 is rotatable about a pin 65*a*. The cam 65 engages with teeth (rack) 67*a* of a cam drive portion 67 formed on the print head 20 to be rotated. A shape of the cam 65 and the cam rotating mechanism are not limited to this example. For instance, the cam rotating mechanism may utilize friction.

In the state of FIG. 8A, the ink tank 10 is not mounted on the print head 20 and the side surface of the communication path 66 is elastically deformed by the cam 65, blocking the communication between the valve chamber 30 and the ink containing chamber 12.

FIG. 8B shows the ink tank 10 mounted to the print head 20. In the ink tank mounting process, the cam 65 engages with the cam drive portion 67 of the print head 20 and, as the cam drive portion 67 moves relative to the cam 65, the cam 65 is rotated, allowing the sidewall portion of the communication path 66 that was elastically deformed by the cam 65 to return to its original shape, opening the communication path 66. While the communication path 66 is formed like a letter I in this embodiment, it may take other constructions. For example, a part of the sidewall may be made elastically deformable so that the communication path 66 can be closed at this portion by a member located outside the ink tank. In place of the cam 65, a spring may be applied so that a biasing force by the spring can close the communication path 66.

In this embodiment since the member (cam 65) that closes the communication path does not have to contact ink, there is no need to consider the problem of components of the cam material dissolving into ink. This enhances the freedom of material selection for the cam member.

Fifth Embodiment

Figure 9A:
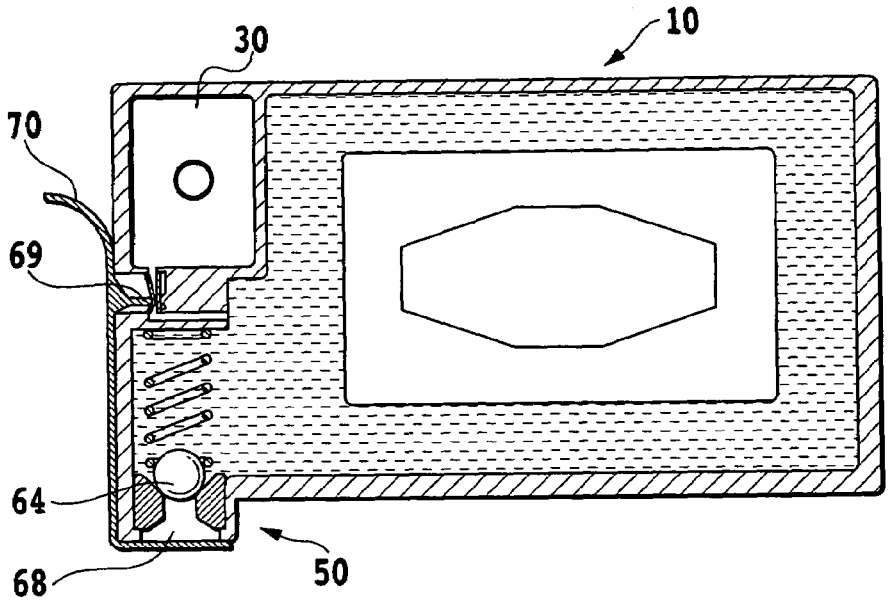
FIGS. 9A and 9B are schematic cross-sectional views showing an ink tank according to a fifth embodiment of the invention, FIG. 9A representing a state in which the ink tank is being transported, FIG. 9B representing a state in which a user is removing a seal tape.
Figure 9B:
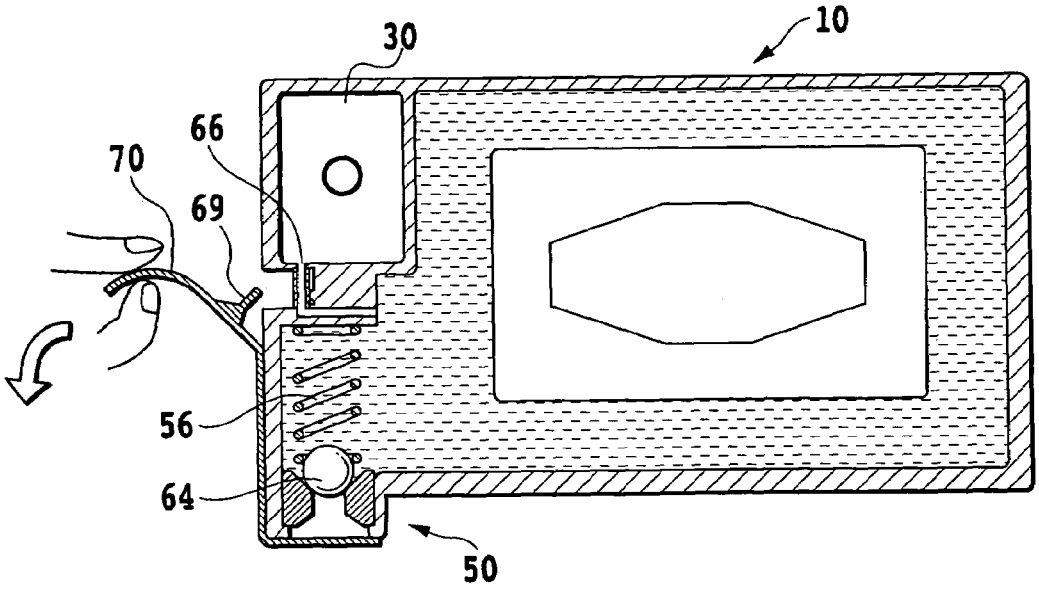

FIGS. 9A and 9B are conceptual cross-sectional views of a fifth embodiment of this invention, FIG. 9A representing a state in which the communication path 66 is closed, FIG. 9B representing a state in which the communication path 66 is open.

This embodiment is characterized in that the communication path 66 is opened by a user. In the state of FIG. 9A, the ink tank 10 is not yet mounted to the print head 20 and the supply port 50 is sealed with a seal tape 68. The seal tape 68 is roughly L-shaped and adheres to a side surface of the ink tank 10 starting from the supply port 50 by means of an adhesive material. This seal tape is used for the following reason. When the ink tank is transported, there is a chance that the ink tank may be subjected to greater temperature changes or impacts than when in use, resulting in ink seeping out of the ink tank. The seal tape 68 prevents the ink that has leaked out from dripping. The seal tape 68 has a protrusion 69 at a portion that is bonded to the side surface of the ink tank 10. During transport, the seal tape 68 is attached to a predetermined portion of the ink tank 10 to seal over the liquid supply portion 50 of the ink tank 10 and the protrusion 69 closes the communication path 66. Thus, ink ingress into the valve chamber can be avoided during transport.

FIG. 9B shows a user removing the seal tape 68 just before mounting the ink tank 10 to the print head. The user holds a handle portion 70 of the seal tape 68 and pulls it off in a direction of arrow to remove it from the ink tank 10. In this process the protrusion 69 is also removed, opening the communication path 66. While in this construction the liquid supply portion 50 is closed by pushing a connection closing member 64 against the seal member 17 by a connection spring member 56, it may be closed by other closing structure such as valve because it is not directly involved in the opening and closing of the communication path 66.

In this embodiment also, since the member (protrusion 69) that closes the communication path does not have to contact ink, there is no need to consider the problem of components of the closing member material dissolving into ink. This enhances the freedom of material selection for the closing member. Further, since the communication path is opened by the user, there is no need to use a complex construction for the ink tank and the opening action can be executed reliably.

Sixth Embodiment

Figure 10A:
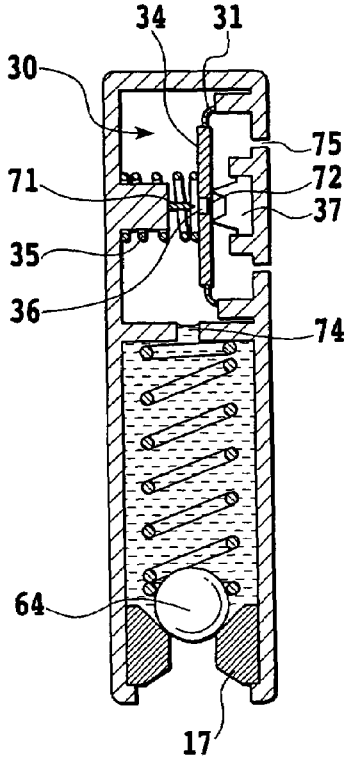
FIGS. 10A, 10B and 10C are schematic cross-sectional views showing an ink tank and a print head according to a sixth embodiment of the invention, FIG. 10A representing a state in which the ink tank is being transported, FIG. 10B representing a state in which a user is opening a communication port, FIG. 10C representing a state in which the ink tank is mounted on the print head and is in use.
Figure 10B:
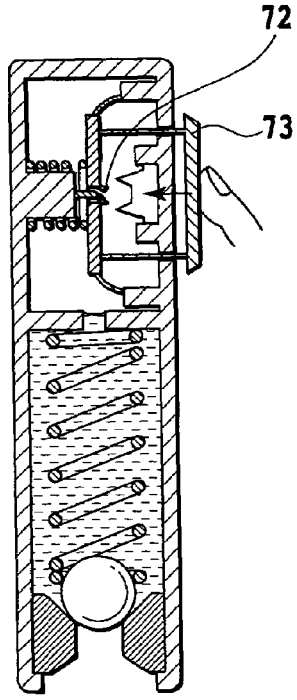
Figure 10C:
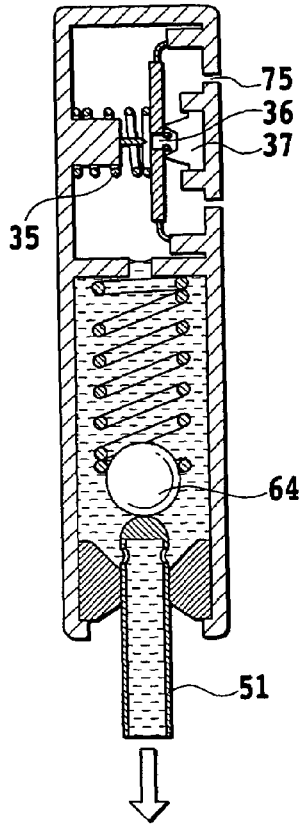

FIGS. 10A, 10B and 10C illustrate conceptual cross-sectional views of a sixth embodiment of this invention. These figures correspond to FIG. 4 of the first embodiment and portions not shown are identical with the corresponding portions of the first embodiment.

FIG. 10A illustrates a state of the ink tank while being transported. What differs from the first embodiment is that there is no closing member in a communication path 74. In FIG. 10A, a meniscus rests stationary in the communication path 74 by a resistance generated by the meniscus. Because of a lack of the closing member in the communication path 74, ink may move between the valve chamber and the ink containing chamber during transport. However, the communication port 36 is attached with a communication port sealing member 72, which prevents ink from reaching the seal portion of the valve disc (contact portion between the pressure plate 34 and the seal member 37). The communication port sealing member 72 is preferably formed of a thin film material that can be punctured by a needle-like member, as in the case with the communication path closing member 60 of the first embodiment. Further, an opening member 71 arranged in the valve chamber and at a position corresponding to the communication port 36. The opening member 71 has its free end portion formed like a needle so as to be able to break the communication port seal member 72. Because the spring member 35 pushes the pressure plate 34 toward the seal member 37, there is a gap between the free end portion of the opening member 71 and the communication port seal member 72. In this state, although ink may enter into the valve chamber, ink will not reach the valve disc seal portion (contact portion between the pressure plate 34 and the seal member 37), whatever attitude the ink tank may take or whatever ambient temperature changes may occur during transport.

Next, a state of FIG. 10B is explained. FIG. 10B represents a state in which, immediately before mounting the ink tank to the print head, the user inserts a pressure plate pushing member 73, constructed as a separate member from the ink tank 10, into a pushing member insertion opening 75 and depresses the pressure plate 34. With this operation the pressure plate 34 is displaced toward the opening member 71 to have the communication port seal member 72 punctured by the opening member 71, thus opening the communication port 36. FIG. 10C shows a state in which the ink tank with the communication port 36 open is mounted to the print head and ink is being supplied. In this state, as in other embodiments, the negative pressure adjustment is made by the one-way valve. As seen from above-mentioned construction, the pushing member insertion opening 75 serves as an atmosphere communication hole.

This embodiment can produce the similar effects to those of other embodiments by adopting simple constructions in which only the opening member 71 and the communication port seal member 72 are installed in the ink tank. Further, the communication port seal member 72 and the sheet member 31 may use the same material and thus may be formed simultaneously in the process of joining the sheet member 31 to the pressure plate 34.

Although in this embodiment the pressure plate pushing member 73 is formed as a separate member and depressed by the user to open the communication port, it may be formed inseparable from the ink tank 10. Further, as in the fourth embodiment, the pressure plate pushing member may be constructed so that it can be depressed by an ink tank mounting force in the process of mounting the ink tank to the print head.

Seventh Embodiment

Figure 11A:
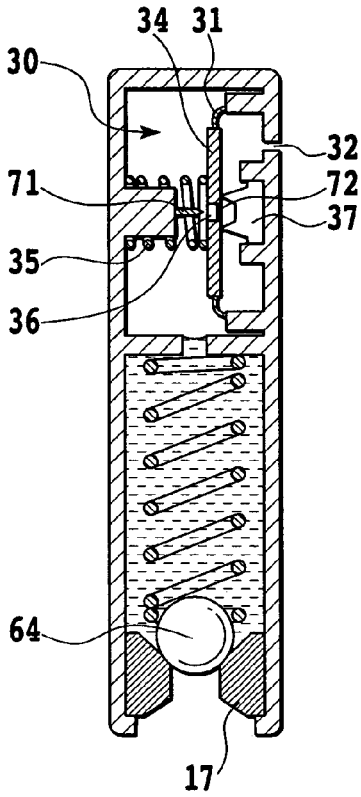
FIGS. 11A, 11B and 11C are schematic cross-sectional views showing an ink tank and a print head according to a seventh embodiment of the invention, FIG. 11A representing a state in which the ink tank is being transported, FIG. 11B representing a state in which the ink tank is mounted on the print head and, as ink consumption proceeds, a communication port is being opened, FIG. 10C representing a state in which the communication port is open, air is introduced and a pressure balance is reached.
Figure 11B:
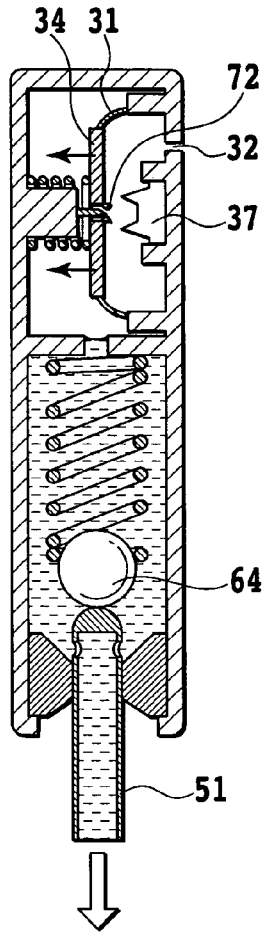
Figure 11C:
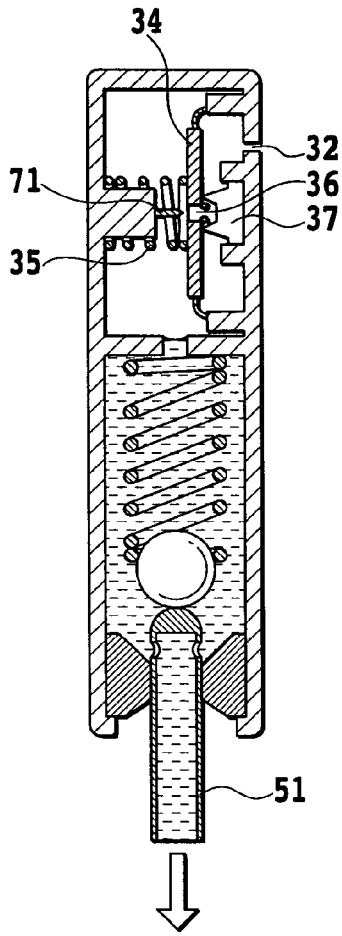

FIGS. 11A, 11B and 11C show conceptual cross-sectional views of a seventh embodiment of this invention. These figures correspond to FIG. 4 of the first embodiment and portions not shown are identical with the corresponding portions of the first embodiment.

FIG. 11A represents a state of the ink tank during transportation, almost similar to the state of FIG. 10A. What differs from FIG. 10A is that this embodiment has no pressing member insertion opening 75 but only the atmosphere communication hole 32 as in the first embodiment. FIG. 11B represents a state in which the ink tank 10 is mounted to the print head 20 and ink is being supplied, with the communication port seal member 72 left closed. Though not shown in this figure, this embodiment has in the ink containing chamber a buffer portion constructed of a sheet member and a spring member, as in the first embodiment. As an ink consumption progresses, the sheet member is deformed reducing a volume of the ink containing chamber. Then, when the negative pressure in the ink containing chamber exceeds the predetermined negative pressure, the pressure plate 34 starts moving. At this time, in the case of the first embodiment, air is introduced into the ink tank to alleviate the negative pressure, which in turn allows the pressure plate 34 to return to its initial position. In this embodiment, however, the presence of the communication port seal member 72 blocks the air introduction and the pressure plate 34 is further displaced until the communication port seal member 72 is broken by the opening member 71, opening the communication port 36. Now, air is introduced through the communication port 36, so that the one-way valve maintains the predetermined negative pressure.

Compared with the sixth embodiment, this embodiment does not require the pressure plate pushing member 73 and also obviates the need for the opening action on the part of the user.

(Example Construction of Ink Jet Print Head)

The print head 20 has a plurality of ink ejection ports arrayed in a predetermined direction (in a direction different from the print head scan direction, in a serial printing system in which the print head mounted on such a member as a carriage relatively scans to a print medium while at the same time ejecting ink onto it as described later;); liquid paths communicating to individual ink ejection ports; and elements arranged in the liquid paths to generate energy for ejecting ink. The ink ejection method of the print head 20 or forms of the energy generation elements is not limited to any particular one. For example, electro-thermal transducers that produce heat when energized may be used as the ink ejection energy generation elements, with the heat energy, which they produce, used to eject ink. In this case, ink is film-boiled by the produced heat of the electrothermal transducers and is expelled from ink ejection ports by energies of expanding bubbles. It is also possible to use electro-mechanical transducers such as piezoelectric elements that deform when applied a voltage and to eject ink by the mechanical energy of the elements.

The print head 20 and the liquid supply unit 50 may be formed disconnectably or inseparably integral. They may also be installed separately and connected through a communication path. When formed integral, they may take a cartridge form that is detachable from a mounting member (e.g., carriage) in a printing apparatus.

Example Construction of Ink Jet Printing Apparatus

Figure 7:
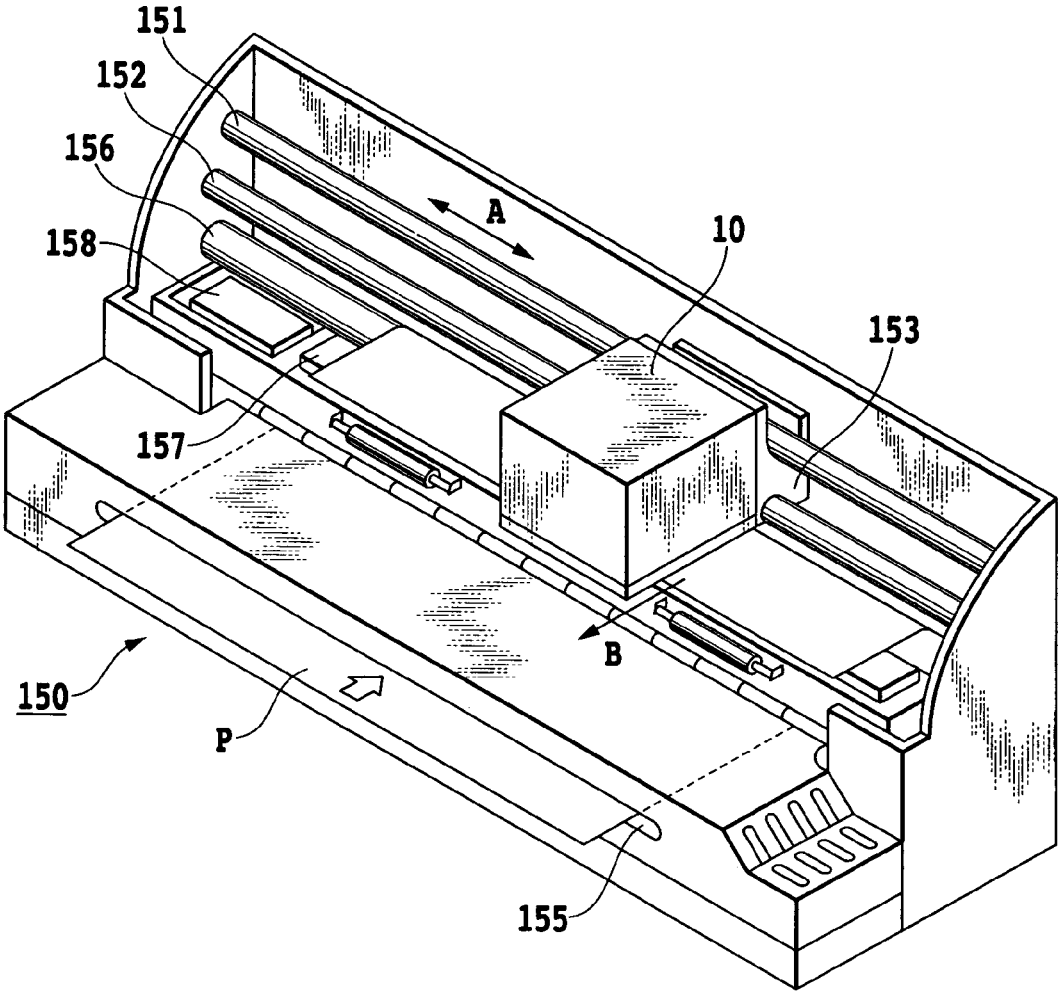
FIG. 7 is a perspective view showing an example construction of an ink jet printing apparatus to which this invention can be applied.

FIG. 7 shows an example construction of an ink jet printing apparatus as a liquid using apparatus that can apply this invention.

A printing apparatus 150 in this example is a serial scan type ink jet printing apparatus. A carriage 153 is supported and guided on guide shafts 151, 152 so that it can be moved in a main scan direction indicated by an arrow A. The carriage 153 is reciprocally moved in the main scan direction by a carriage motor and a drive force transmission mechanism such as belt that transmits the motor drive force. The carriage 153 mounts a print head 20 (not shown in FIG. 7) and an ink tank 10 that supplies ink to the print head 20. The print head 20 and the ink tank 10 are constructed in ways similar to the preceding embodiments and may form an ink jet cartridge. Paper P as a print medium is inserted from an insertion opening 155 provided at the front of the apparatus. After its transport direction is reversed, the paper P is fed by a feed roller 156 in a subscan direction indicated by an arrow B. The printing apparatus 150 forms an image successively on the paper P by alternately performing a printing operation and a paper feed operation. The printing operation causes the print head 20 to eject ink onto a print area of the paper P on a platen 157 while moving the print head 20 in the main scan direction; and the paper feed operation feeds the paper P in the subscan direction a distance corresponding to the printing width.

The print head 20 may be of a type that uses a thermal energy generated by electrothermal transducers for ejecting ink. In that case, heat of the electro-thermal transducers is used to cause a film boiling in ink to generate bubbles and thereby expel ink from ink ejection ports. The ink ejection method is not limited to this type that uses the electro-thermal transducers and may use piezoelectric elements to eject ink.

At the left end of a movable range of the carriage 153 in FIG. 7 is installed a recovery unit (ejection performance recovery means) 158 which opposes a face of the print head 20 on the carriage 153 which is formed with ink ejection ports. The recovery unit 158 has a cap capable of capping ink ejection ports of the print head 20 and a suction pump for introducing a negative pressure into the cap. The recovery unit 158 performs a recovery operation (also referred to as a "suction-based recovery operation") by introducing a negative pressure into the cap that is hermetically enclosing the ink ejection ports to suck out ink from the ink ejection ports to maintain the ink ejection performance of the print head 20 in good condition. It is also possible to perform another type of recovery operation (also referred to as an "ejection-based recovery operation") in which the print head 20 ejects ink not contributing to the formation of image from the ink ejection ports toward the inside of the cap.

In the printing apparatus of this example, the ink tank 10 mounted on the carriage 153 along with the print head 20 supplies ink to the print head 20.

While the above description concerns a case where the present invention is applied to an ink tank that supplies ink to a print head, the invention can also be applied to an ink supply unit that supplies ink to a pen as a recording unit.

In addition to these printing apparatus, this invention can also be applied widely to devices that supply various kinds of liquids, such as drinking water and liquid artificial seasoning, and to devices in a medical field for supplying medicine.

Further, this invention can be applied to various types of printing apparatus in addition to the serial scan type. For example, this invention may be implemented as a so-called full line type printing apparatus which uses an elongate print head spanning over the full length of the print area of the print medium.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A liquid container comprising:

a liquid containing portion defining a space for containing liquid;

a liquid supply portion installed in the liquid containing portion to supply the liquid from liquid containing portion to a liquid using portion; and a valve to introduce the atmosphere into the liquid containing portion to adjust a negative pressure in the liquid containing portion, the negative pressure being created as the liquid in the liquid containing portion is consumed;

wherein the valve can be closed by pressing a valve disc against a seal member;

wherein the liquid container further includes a closing member installed in a path, the path establishing a communication between a seal portion at which the valve disc and the seal member contact each other and the liquid containing portion, the closing member being capable of enabling or disabling the communication through the path.

2. A liquid container as claimed in claim 1, further including:

a valve chamber in which the valve is installed; and a communication path connecting the valve chamber with the liquid containing portion;

wherein the closing member closes the communication path.

3. A liquid container as claimed in claim 1, wherein the closing member is normally closed and, when the liquid using portion consuming the liquid and the liquid container are connected with each other, enables the fluidal communication.

4. A liquid container as claimed in claim 1, wherein the closing member is a film member which, when broken, enables the communication.

5. A liquid container as claimed in claim 1, wherein, after the closing member is opened, if the liquid container and the liquid using portion are not connected with each other, the closing member returns to a closed state.

6. A liquid container as claimed in claim 5, wherein the closing member is formed of a rubber material having a slit therein.

7. A liquid container as claimed in claim 5, wherein the closing member is a check valve.

8. A liquid container as claimed in claim 1, wherein the liquid container has a connection closing member that closes the liquid supply portion when the liquid container is not connected to the liquid using portion; and when the liquid container is connected to the liquid using portion, the liquid supply portion opening action by the connection closing member causes the liquid supply portion to enable the communication.

9. A liquid container as claimed in claim 8, wherein a mechanism portion of the connection closing member that causes the closing member to open the communication path is formed hollow.

10. A liquid container as claimed in claim 1, further including:

a movable portion displaceably or deformably provided in at least a part of the liquid containing portion; and a biasing means for urging the movable portion in a direction that increases a volume of the liquid containing space;

wherein, as the liquid is supplied to the outside, the biasing means is displaced to cause the closing member to open the communication path.

11. A liquid container as claimed in claim 1, wherein the communication path has a communication path movable portion deformably provided in at least a part of a sidewall thereof, and the closing member presses the communication path movable portion to close the communication path.

12. A liquid container as claimed in claim 11, wherein, in a process of connecting the liquid container to the liquid using portion, an action from the liquid using portion opens the closing member.

13. A liquid container as claimed in claim 11, wherein the closing member is formed integral with a packaging material packaging the liquid container and, in a process of removing the packaging material, the closing member is opened.

14. A liquid container as claimed in claim 1, wherein the sealing member closes an atmosphere introduction port formed in the valve disc.

15. A liquid using apparatus connectable to the liquid container of claim 1 and using the liquid supplied from the liquid containing space.

16. A liquid using apparatus as claimed in claim 15, having a form of print head which performs printing by using ink supplied from the liquid container containing ink as the liquid.

17. A printing apparatus comprising a means to perform printing by using the liquid using apparatus of claim 16 which has the form of print head.

18. An ink jet print head cartridge comprising:

an ink jet print head to eject ink; and the liquid container of claim 1 for containing, as the liquid, ink to be supplied to the ink jet print head.

* * * * *